US011165183B2

(12) United States Patent
McKeever et al.

(10) Patent No.: US 11,165,183 B2
(45) Date of Patent: Nov. 2, 2021

(54) CONNECTOR COVER WITH SEPARATE ACTIVATION AND LATCHING MECHANISMS

(71) Applicant: International Business Machines Corporation, Armonk, NY (US)

(72) Inventors: Eric James McKeever, Pleasant Valley, NY (US); Edward J. Seminaro, Milton, NY (US); David P. Graybill, Staatsburg, NY (US); Thong N. Nguyen, Poughkeepsie, NY (US); Wayne A. Barringer, Wallkill, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/805,163

(22) Filed: Feb. 28, 2020

(65) Prior Publication Data

US 2021/0273367 A1 Sep. 2, 2021

(51) Int. Cl.

| | |
|---|---|
| ***H01R 13/631*** | (2006.01) |
| ***H01R 13/453*** | (2006.01) |
| ***E05F 1/12*** | (2006.01) |

(52) U.S. Cl.

CPC ..... *H01R 13/4532* (2013.01); *E05F 1/1207* (2013.01); *H01R 13/631* (2013.01); *E05Y 2900/606* (2013.01)

(58) Field of Classification Search

CPC . H01R 13/4532; H01R 13/631; E05F 1/1207; E05Y 2900/606

See application file for complete search history.

(56) References Cited

U.S. PATENT DOCUMENTS

| | | | | |
|---|---|---|---|---|
| 4,842,543 | A * | 6/1989 | Davis | H01R 13/645 439/246 |
| 4,963,098 | A | 10/1990 | Myer | |
| 5,344,331 | A | 9/1994 | Hoffman et al. | |
| 5,391,091 | A | 2/1995 | Nations | |
| 5,716,224 | A | 2/1998 | Masuda et al. | |
| 6,164,991 | A * | 12/2000 | Matsuura | H01R 13/6275 439/157 |
| 6,354,852 | B2 | 3/2002 | Noro | |
| 6,413,105 | B2 | 7/2002 | Noro et al. | |

(Continued)

*Primary Examiner* — Truc T Nguyen

(74) *Attorney, Agent, or Firm* — Garg Law Firm, PLLC; Rakesh Garg; William Hartwell

(57) ABSTRACT

An apparatus includes a connector cover and a lever arm coupled to the connector cover, the lever arm being shaped to accommodate a portion of an activating pin, wherein contact of the activating pin with the lever arm causes a movement of the connector cover from a first position to a second position. The apparatus includes a latch assembly comprising a clamp, the clamp in a clamped position preventing the connector cover from moving from the first position to a second position. The apparatus includes a first bracket with a first indentation, the first indentation being sized to accommodate a portion of a first locating pin, wherein an insertion of the first locating pin into the first indentation moves the clamp from the clamped position to an unclamped position, the unclamped position permitting the connector cover to move when activated by the insertion of the activating pin.

20 Claims, 15 Drawing Sheets

(56) References Cited

U.S. PATENT DOCUMENTS

| | | | | |
|---|---|---|---|---|
| 6,688,780 | B2 | 2/2004 | Duran | |
| 7,258,556 | B1 | 8/2007 | Boutros et al. | |
| 8,545,275 | B2 | 10/2013 | Wang et al. | |
| 8,992,268 | B2 * | 3/2015 | Casses | H01R 13/111 439/816 |
| 2003/0176090 | A1 | 9/2003 | Kozono et al. | |
| 2011/0128680 | A1 * | 6/2011 | Martinez | B41F 23/0409 361/679.01 |
| 2011/0175375 | A1 * | 7/2011 | Terhaar | E05B 79/20 292/220 |
| 2012/0257353 | A1 | 10/2012 | Babcock et al. | |
| 2013/0017696 | A1 | 1/2013 | Alvarez Rivera | |
| 2015/0159412 | A1 * | 6/2015 | Seitz | E05B 17/2053 292/128 |
| 2015/0250312 | A1 * | 9/2015 | Barrett | A47B 88/463 312/319.1 |
| 2015/0253160 | A1 | 9/2015 | Murphy et al. | |
| 2015/0372418 | A1 * | 12/2015 | Richards | H01R 13/62933 439/536 |
| 2016/0036204 | A1 * | 2/2016 | Schroeder | H02B 11/133 200/50.22 |
| 2017/0017276 | A1 | 1/2017 | Ganta | |
| 2018/0376621 | A1 | 12/2018 | Campbell et al. | |
| 2019/0190203 | A1 * | 6/2019 | Sawada | H01R 13/631 |
| 2019/0341729 | A1 | 11/2019 | Gniadek | |
| 2020/0178413 | A1 * | 6/2020 | Thibaut | H05K 7/20772 |

* cited by examiner

CONNECTOR COVER WITH SEPARATE ACTIVATION AND LATCHING MECHANISMS

TECHNICAL FIELD

The present invention relates generally to a method and apparatus including a connector cover. More particularly, the present invention relates to a method and apparatus including a connector cover with separate activation and latching mechanisms.

BACKGROUND

Modular mechanical components are often physically connected or mechanically coupled to each other or to other infrastructure using connectors. A connector couples two or more components together. Some connectors are not integrated into a larger apparatus. For example, a nail is a connector that can be used to couple two pieces of wood together. Other connectors are integrated into a larger apparatus. For example, a dovetail joint is often used to couple two pieces of wood together at a right angle. In a dovetail joint, a series of trapezoidal pins cut to extend from the end of one piece of wood interlock with a series of trapezoidal tails cut into the end of another piece of wood. The set of pins and the set of tails are both connectors. A connector can be made of any suitable material, for example, wood, metal, or plastic.

When used in electrically powered hardware, connectors are often used to conduct electrical power and signals between components. These connectors have both an electrical portion—contact points that conduct electricity between components—and a mechanical portion that holds the contact points in contact with each other. For example, nine-volt batteries commonly include two contact points, each shaped to serve as a mechanical connector coupling the battery to a corresponding set of battery receptacles within the device to be powered. Electricity also flows through the connector to power the device. A connector with an electrical portion can be made of any suitable conductive material, for example metal, or the electric portion can be made of a conductive material and the mechanical portion made of the same or a different material that may or may not be conductive. For example, some connectors with electrical portions include contact points made of a conductive material surrounded by a plastic material. The plastic material serves both as an insulator and to shape and orient the connector to made with a corresponding connector of another device.

SUMMARY

The illustrative embodiments provide an apparatus and a method. An embodiment includes an apparatus that includes a connector cover. An embodiment includes a lever arm coupled to the connector cover, the lever arm being shaped to accommodate a portion of an activating pin, wherein contact of the activating pin with the lever arm causes a movement of the connector cover from a first position to a second position. An embodiment includes a latch assembly comprising a clamp, the clamp in a clamped position preventing the connector cover from moving from the first position to a second position. An embodiment includes a first bracket with a first indentation, the first indentation being sized to accommodate a portion of a first locating pin, wherein an insertion of the first locating pin into the first indentation moves the clamp from the clamped position to an unclamped position, the unclamped position permitting the connector cover to move when activated by the insertion of the activating pin.

An embodiment includes a first chassis, including a connector cover, lever arm, latch assembly, and first indentation. An embodiment includes a second chassis, including an activating pin and first locating pin. An embodiment includes a method that provides a connector cover, lever arm, latch assembly, and first indentation.

BRIEF DESCRIPTION OF THE DRAWINGS

Certain novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

DETAILED DESCRIPTION

Figure 1:
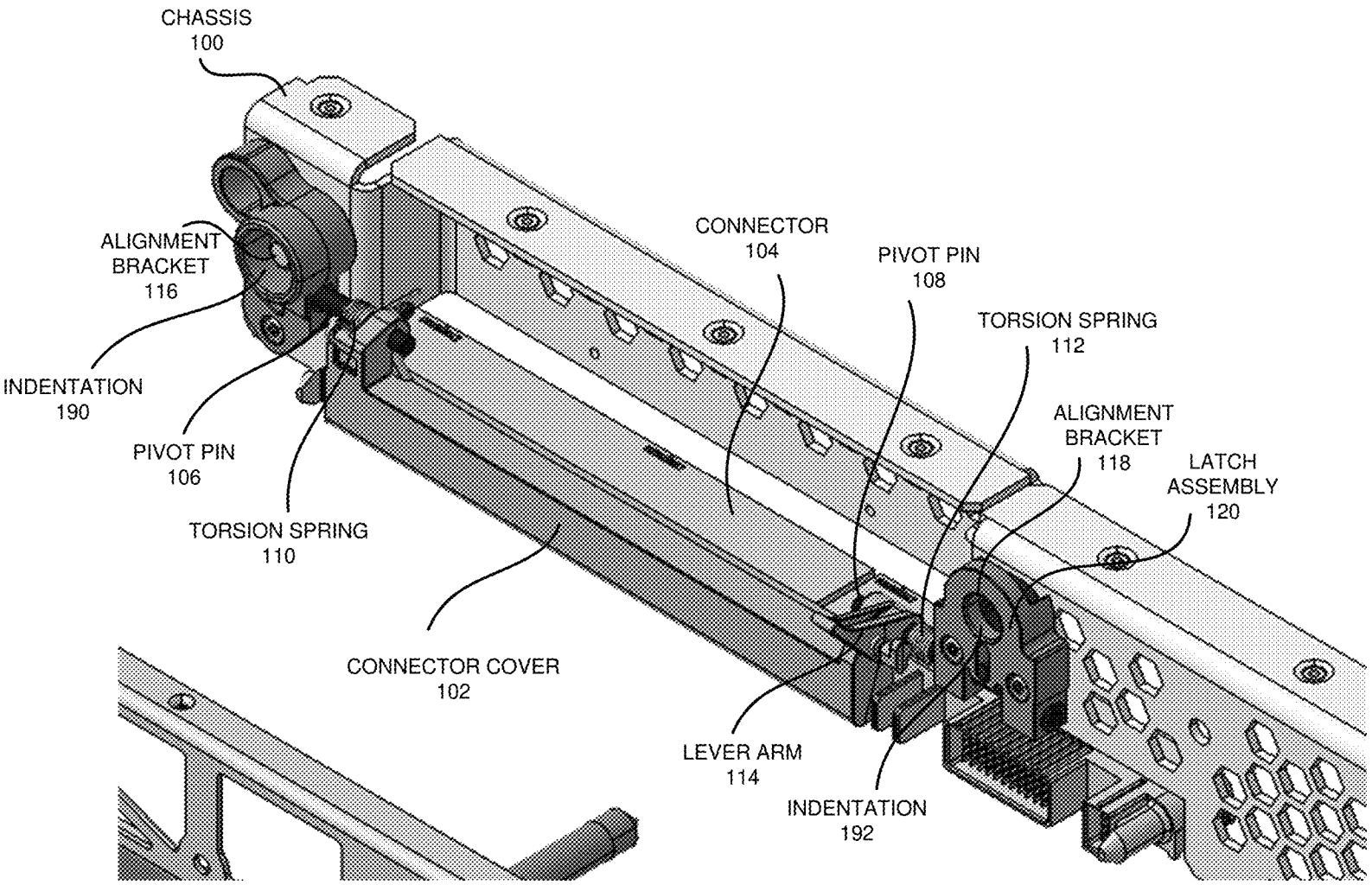
FIG. 1 depicts an isometric view of an example configuration for a chassis including a connector cover with separate activation and latching mechanisms in accordance with an illustrative embodiment.

The illustrative embodiments recognize that an exposed component connector can result in damage to components and pose a hazard to those handling the components. An exposed component connector is one that is contactable, physically or electrically, from outside the connector or the component of which the connector is a part. A component connector can be mechanically exposed. For example, a component connector might have a sharp point or edge that could scratch other components or a human handler. As another example, an exposed connector is often an entry point for dust, liquid, or other contamination into a component's interior. A component connector can also be electrically exposed. For example, touching an exposed electrical connector carrying more than a threshold voltage could cause an electrical shock or a short circuit.

Consequently, component connectors are often required to be protected from contact when not being used. A cover provides such protection. A mechanical cover prevents a portion of an exposed component connector from being physically contacted from outside the component of which the connector is a part. An electrical cover prevents a portion of an exposed component connector from being electrically contacted from outside the component of which the connector is a part. A cover can be made of any suitable material, for example, wood, metal, or plastic. A cover in electrical contact with an electrically exposed connector can be made of any suitable insulating material. A cover serving both a mechanical and electrical function (for example, when a cover protecting an electrical connector is situated with an air gap between the connector and the cover) need not be made of an insulating material, because the air gap provides sufficient insulation. A cover is also removable, to expose the connector when the connector is to be used. Thus, a cover is positionable in a first, or covered or closed position, in which no portion of the covered connector is exposed. A cover that remains+coupled to the component of which the connector is a part is also repositionable from the first position to one or more second, or uncovered or open positions, in which at least a portion of the covered connector is exposed. A cover that has been detached from the component of which the connector is a part is also in an open position.

The illustrative embodiments also recognize that, to prevent inadvertent connector exposure, a connector cover should be prevented from moving from the closed position without an affirmative action. Examples of some affirmative actions include unscrewing one or more screws maintaining a cover in the closed position, unlatching a latch maintaining a cover in the closed position, overcoming a spring force maintaining a cover in the closed position, and the like.

The illustrative embodiments also recognize that, to enable insertion and removal of modular hardware, a cover must be reoriented away from the closed position, or removed completely, to allow mating connectors to connect. A cover must also have a default position (the closed position) to maintain component protection. In addition, connectors are often hidden within a chassis and not easily accessible, thus requiring automatic connector alignment and cover disengagement and engagement.

The illustrative embodiments also recognize that, for improved design flexibility and cost efficiency, there is a need to separate a cover latching mechanism from a cover activation mechanism. A cover latching mechanism secures, fastens, fixes in place, or renders a connector cover immovable from the covered position, for example, but not limited to when the connector is not being used, and renders the connector cover movable to an uncovered position, for example, but not limited to when unlatched. A cover activation mechanism moves, articulates, translates, or rotates a cover, or causes motion or articulation of the cover, subject to the latching mechanism being in a position to allow such motion or articulation, the cover when the cover is unlatched. When cover latching and cover activation mechanisms are separate, one cover latching mechanism can latch one cover. As well, when cover latching and cover activation mechanisms are separate, one cover latching mechanism can latch more than one cover. In addition, the latching mechanism can be placed in any convenient location, not necessarily adjacent to the cover being latched.

Consequently, the illustrative embodiments recognize that there is an unmet need for a component cover that opens and closes automatically, is prevented from moving from the closed position without an affirmative action, and uses separate latching and activation mechanisms.

The illustrative embodiments recognize that the presently available tools or solutions do not address these needs or provide adequate solutions for these needs. The illustrative embodiments used to describe the invention generally address and solve the above-described problems and other problems related to a connector cover with separate activation and latching mechanisms.

The illustrative embodiments are described using example connectors and connector covers which can be improved in a manner described herein. Any reference to a specific connector or connector cover is not intended to be limiting on the illustrative embodiments. An embodiment described herein can be adapted to address similar problems in other devices where a connector cover with separate activation and latching mechanisms is desired.

An embodiment comprises an apparatus including a connector cover described herein. Particularly, some illustrative embodiments provide an apparatus including a connector cover and a lever arm coupled to the connector cover. The connector cover is maintained in the closed position by a closing force. In an embodiment, a spring provides the closing force. The lever arm causes the connector cover to be repositioned from the closed position to a different position, when an opening force, sufficient to overcome the closing force, is exerted on the lever arm. Removal of the opening force from the lever arm causes the connector cover to be repositioned from the different position back to the original, closed position. In embodiments, the lever arm has a shape, a coupling location to the connector cover, and an orientation relative to the connector cover such that the opening force applied to the lever arm causes the connector cover to be repositioned from the closed position to a desired position from which the covered connector is accessible for connecting. In one embodiment, the lever arm extends outward from the connector cover (in a direction opposite from the connector), and inward opening force on the lever arm is greater than the closing force, causing both the lever arm and the cover to rotate from the closed position. In another embodiment, opening force on the lever arm causes the cover to translate from the closed position.

In one embodiment, the force is provided by contact with an activating pin, and thus the lever arm is shaped to accommodate a portion of the activating pin. Thus, contact of the activating pin with the lever arm causes a movement of the connector cover from a first position to a second position, and removal of the contact causes a movement of the connector cover back to the first position. In one embodiment, the lever arm includes an indentation and the activating pin includes a portion shaped to fit within the indentation.

In one embodiment, both the indentation and the activating pin have corresponding, generally circular shapes. In another embodiment, both the indentation and the activating pin have corresponding polygonal shapes. In another embodiment, the indentation is shaped to accommodate a screwdriver (for example, a flat-blade or Philips-head screwdriver) and the activating pin includes a portion shaped to fit within the indentation.

The apparatus includes a latch assembly including a clamp. The clamp has a clamped position and an unclamped position. In a clamped position, the clamp prevents the connector cover from moving from the first position to a second position. In the unclamped position, the clamp allows the connector cover to move from the first position to a second position. In embodiments, the clamp includes components suitable for preventing the connector cover from moving and allowing the connector cover to move as appropriate. In an embodiment, the clamp is held in the clamped position by a spring, and moved to the unclamped position by an extension force causing the spring to extend.

In an embodiment, the apparatus includes a region accommodating insertion of an unlatching activator. Insertion of the unlatching activator causes the clamp to move from the clamped to the unclamped position. In one embodiment, the region is a bracket with an indentation, and an alignment pin serves as an unlatching activator. An insertion of an alignment pin into the indentation moves the clamp from the clamped position to an unclamped position, permitting the connector cover to move when activated by the insertion of the activating pin.

One embodiment includes a cover latching and cover activation mechanism for each connector cover. Another embodiment includes one cover latching mechanism that unlatches multiple covers, and separate cover activation mechanisms for one or more of the multiple covers. In one embodiment, a cover latching mechanism is adjacent to the cover being latched. In another embodiment, a cover latching mechanism is remote from the cover being latched. In another embodiment, a cover latching mechanism is adjacent to one cover being latched and remote from another cover being latched.

Another embodiment comprises a second apparatus including components for initiating the connector cover's activation and latching mechanisms. Particularly, some illustrative embodiments provide an apparatus including an activating pin and an alignment pin. Another embodiment comprises a method of electrical and mechanical coupling using a connector cover described herein.

The manner of a connector cover with separate activation and latching mechanisms described herein is unavailable in the presently available methods in the technological field of endeavor pertaining to connector covers. An apparatus of an embodiment described herein comprises substantial advancement of the functionality of that device or data processing system in providing a connector cover and a lever arm coupled to the connector cover, a latch assembly including a clamp, and a bracket with an indentation. The clamp in a clamped position prevents the connector cover from moving from the first position to a second position. An insertion of an alignment pin into the indentation moves the clamp from the clamped position to an unclamped position, permitting the connector cover to move when activated by the insertion of the activating pin.

The illustrative embodiments are described with respect to certain types of connectors, connector covers, chassis, activating pins, locking pins, pivot pins, clamps, compression springs, torsion springs, devices, components, and apparatuses only as examples. Any specific manifestations of these and other similar artifacts are not intended to be limiting to the invention. Any suitable manifestation of these and other similar artifacts can be selected within the scope of the illustrative embodiments.

The examples in this disclosure are used only for the clarity of the description and are not limiting to the illustrative embodiments. Additional implementations, operations, actions, and manipulations will be conceivable from this disclosure and the same are contemplated within the scope of the illustrative embodiments.

Furthermore, simplified diagrams of the example structures, elements, and device(s) are used in the figures and the illustrative embodiments. In an actual implementation of a proposed apparatus, additional structures that are not shown or described herein, or structures different from those shown and described herein, may be present without departing the scope of the illustrative embodiments. Similarly, within the scope of the illustrative embodiments, a shown or described structure in the example device may be implemented differently to yield a similar operation or result as described herein.

Differently shaded portions in the two-dimensional drawing of the example structures, layers, and formations are intended to represent different structures, layers, and formations in the example fabrication, as described herein. The different structures, layers, and formations may be fabricated using suitable materials that are known to those of ordinary skill in the art as belonging to the same class of materials described herein.

A specific shape, location, position, or dimension of a shape depicted herein is not intended to be limiting on the illustrative embodiments unless such a characteristic is expressly described as a feature of an embodiment. The shape, location, position, dimension, or some combination thereof, are chosen only for the clarity of the drawings and the description and may have been exaggerated, minimized, or otherwise changed from actual shape, location, position, or dimension that might be used in actual implementation to achieve an objective according to the illustrative embodiments.

Furthermore, the illustrative embodiments are described with respect to a specific actual or hypothetical apparatus only as an example. Those of ordinary skill in the art will be able to use an embodiment to provide an apparatus in a similar manner, and such usage is also contemplated within the scope of the illustrative embodiments.

Any advantages listed herein are only examples and are not intended to be limiting to the illustrative embodiments. Additional or different advantages may be realized by specific illustrative embodiments. Furthermore, a particular illustrative embodiment may have some, all, or none of the advantages listed above.

With reference to FIG. 1, this figure depicts an isometric view of an example configuration for a chassis including a connector cover with separate activation and latching mechanisms in accordance with an illustrative embodiment.

As depicted, chassis 100 includes connector cover 102 covering connector 104. Because connector cover 102 is covering connector 104, connector cover 102 is in a closed position. Connector cover 102 is movable between the closed position, covering connector 104, and an open position that exposes connector 104. In one embodiment, connector cover 102 is coupled to one of pivot pins 106 and 108, and moves between the closed and open positions by a rotation of one of pivot pins 106 and 108. In another embodiment, connector cover 102 is coupled to both of pivot pins 106 and 108, and moves between the closed and open positions by a rotation of both of pivot pins 106 and 108. In another embodiment, connector cover 102 is coupled to a different mechanism used to move connector cover 102 between closed and open positions.

In an embodiment, lever arm 114 is coupled to connector cover 102. Lever arm 114 is shaped to accommodate a portion of an activating pin, and configured such that contact with an activating pin (not shown) overcomes a force maintaining connector cover 102 in the closed position and causes connector cover 102 to move from the closed position to the open position. When the activating pin no longer exerts sufficient force on lever arm 114 (for example due to removal of the activating pin), connector cover 102 returns to the closed position.

In embodiments, the force maintaining connector cover 102 in the closed position is provided by a spring. In one embodiment, pivot pin 106 extends through torsion spring 110 and pivot pin 108 extends through torsion spring 112. Torsion springs 110 and 112 supply a torque on connector cover 102 about pivot pins 106 and 108, maintaining connector cover 102 in the closed position in the absence of contact with an activating pin. In another embodiment, pivot pin 106 extends through torsion spring 110, and pivot pin 108 and torsion spring 112 are absent. In another embodiment, one or more of torsion springs 110 and 112 are replaced by a different type of spring configured to maintain connector cover 102 in the closed position in the absence of contact with an activating pin. In another embodiment, connector cover 102 is maintained in the closed position using a mechanism other than a spring.

Chassis 100 also includes latch assembly 120. Latch assembly 120, when latched, prevents connector cover 102 from moving from the closed to the open position. Latch assembly 120, when unlatched, allows connector cover 102 to move from the closed to the open position.

Latch assembly 120 includes alignment bracket 118. Alignment bracket 118 includes indentation 192, an indentation sized to accommodate a portion of an alignment pin (not shown). An insertion of a portion of an alignment pin causes latch assembly 120 to unlatch. Absence of insertion of a portion of an alignment pin causes latch assembly 120 to latch. Although latch assembly 120 is depicted on the right side of chassis 100, in embodiments latch assembly 120 is located at any convenient location of chassis 100, and need not be in any specific orientation or location with respect to lever arm 114. In addition, one latch assembly 120 is usable to latch or unlatch multiple connector covers 102. An embodiment using multiple connector covers 102 is useful when one large connector 104 or multiple small connectors 104 require covering. Further, when multiple connector covers 102 are used, one lever arm 114 can be coupled to multiple connector covers 102.

Optionally, chassis 100 also includes alignment bracket 116, including indentation 190, an indentation sized to accommodate a portion of an alignment pin (not shown). Together, alignment brackets 116 and 118 facilitate blind plugging of connector 104, by locating chassis 100 with sufficient accuracy to ensure that connector 104 will connect to a counterpart connector if insertion is continued. In one embodiment, chassis 100 is placed on mounting rails and inserted into a rack until contacting another chassis already fixed to the rack.

In one embodiment, chassis 100 includes one or more batteries intended as a backup power source to components of the fixed chassis or components coupled to the fixed chassis, and connector 104 couples the set of batteries to a power consumer. Due to the voltage supplied by the set of batteries, connector 104 should be covered when not in use to avoid causing an electrical shock or a short circuit.

Figure 2:
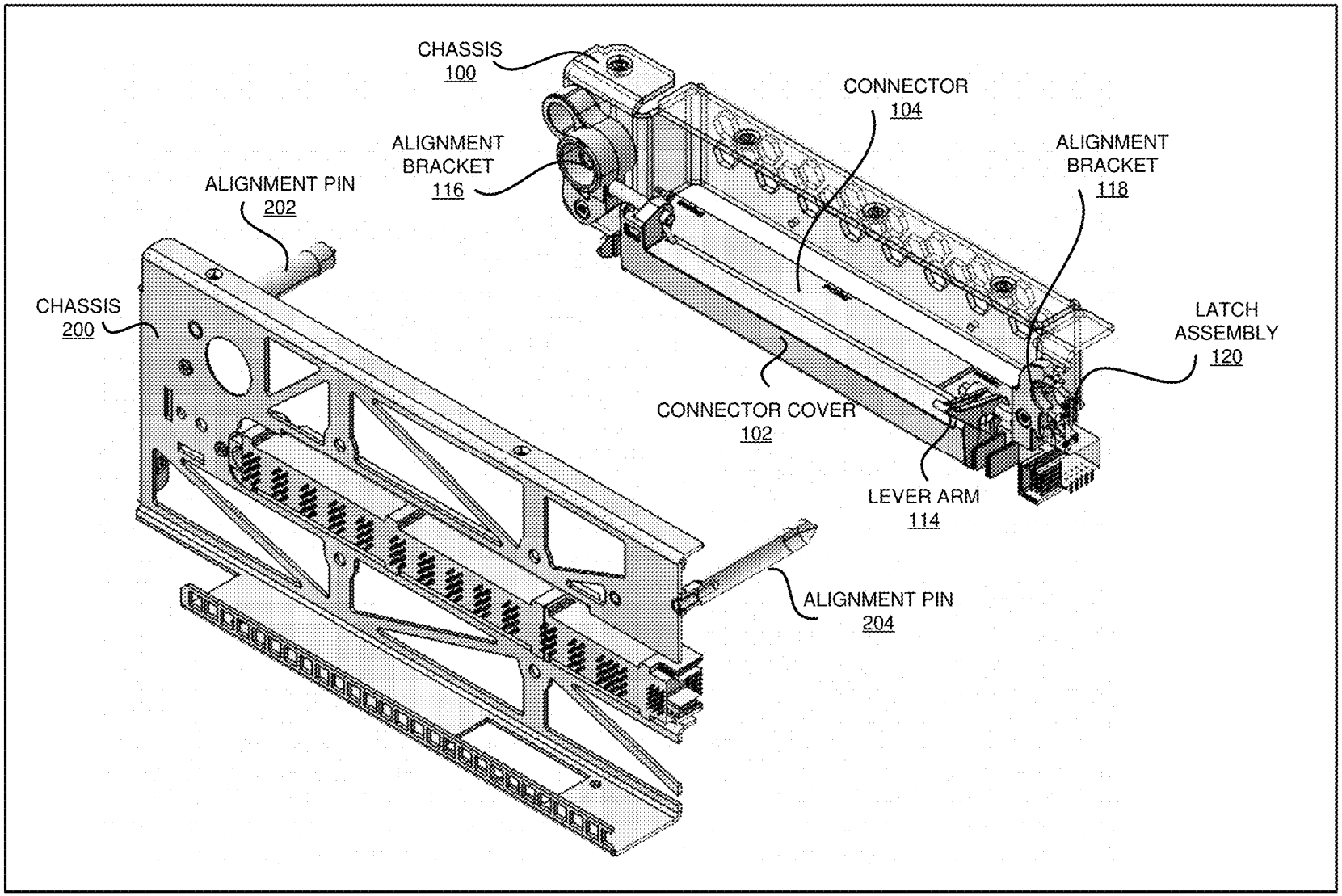
FIG. 2 depicts an isometric view of an example configuration for a chassis including a connector cover with separate activation and latching mechanisms, and a second chassis intended to connect with the chassis, in accordance with an illustrative embodiment.

With reference to FIG. 2, this figure depicts an isometric view of an example configuration for a chassis including a connector cover with separate activation and latching mechanisms, and a second chassis intended to connect with the chassis, in accordance with an illustrative embodiment. Chassis 100, connector cover 102, connector 104, lever arm 114, alignment brackets 116 and 118, and latch assembly 120 are the same as chassis 100, connector cover 102, connector 104, lever arm 114, alignment brackets 116 and 118, and latch assembly 120 in FIG. 1.

In one embodiment, chassis 200 includes alignment pins 202 and 204. Alignment pin 202 is intended to be at least partially inserted into alignment bracket 116, and alignment pin 204 is intended to be at least partially inserted into alignment bracket 118. Together, alignment pins 202 and 204 facilitate blind plugging of connector 104 with a corresponding, counterpart connector (not shown) in chassis 200, by aligning chassis 100 and chassis 200 with sufficient accuracy to ensure that connector 104 will connect to its counterpart connector if insertion is continued. In addition, alignment pin 204, when at least partially inserted into alignment bracket 118, causes latch assembly 120 to unlatch. Absence of insertion of a portion of alignment pin 204 causes latch assembly 120 to latch. In other embodiments, chassis 200 includes more or fewer alignment pins. In another embodiment, alignment pin 204 functions as an unlatching pin for latch assembly 120, and does not have an alignment function.

Figure 3:
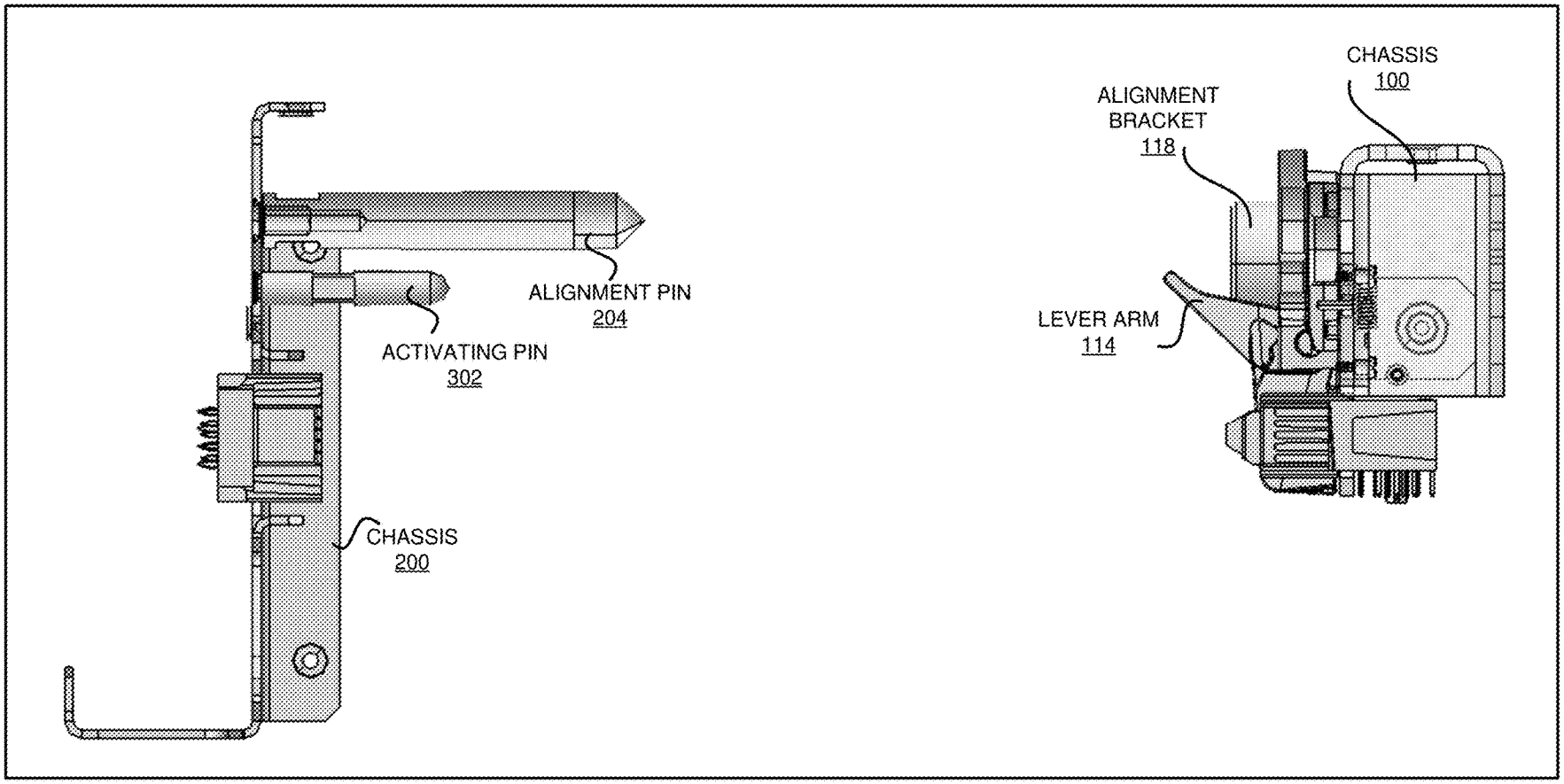
FIG. 3 depicts a section view of an example configuration for a chassis including a connector cover with separate activation and latching mechanisms, and a second chassis intended to connect with the chassis, in accordance with an illustrative embodiment.

With reference to FIG. 3, this figure depicts a section view of an example configuration for a chassis including a connector cover with separate activation and latching mechanisms, and a second chassis intended to connect with the chassis, in accordance with an illustrative embodiment. Chassis 100, lever arm 114, and alignment bracket 118 are the same as chassis 100, lever arm 114, and alignment bracket 118 in FIG. 1. Chassis 200 and alignment pin 204 are the same as chassis 200 and alignment pin 204 in FIG. 2.

In particular, the section view illustrates a top or bottom surface of chassis 100 and 200. Activating pin 302 is also depicted. Lever arm 114 is coupled to connector cover 102. Lever arm 114 is configured such that contact with activating pin 302 overcomes a force maintaining connector cover 102 in the closed position and causes connector cover 102 to move from the closed position to the open position. When activating pin 302 no longer exerts sufficient force on lever arm 114 (for example due to removal of chassis 200), connector cover 102 returns to the closed position.

Figure 4:
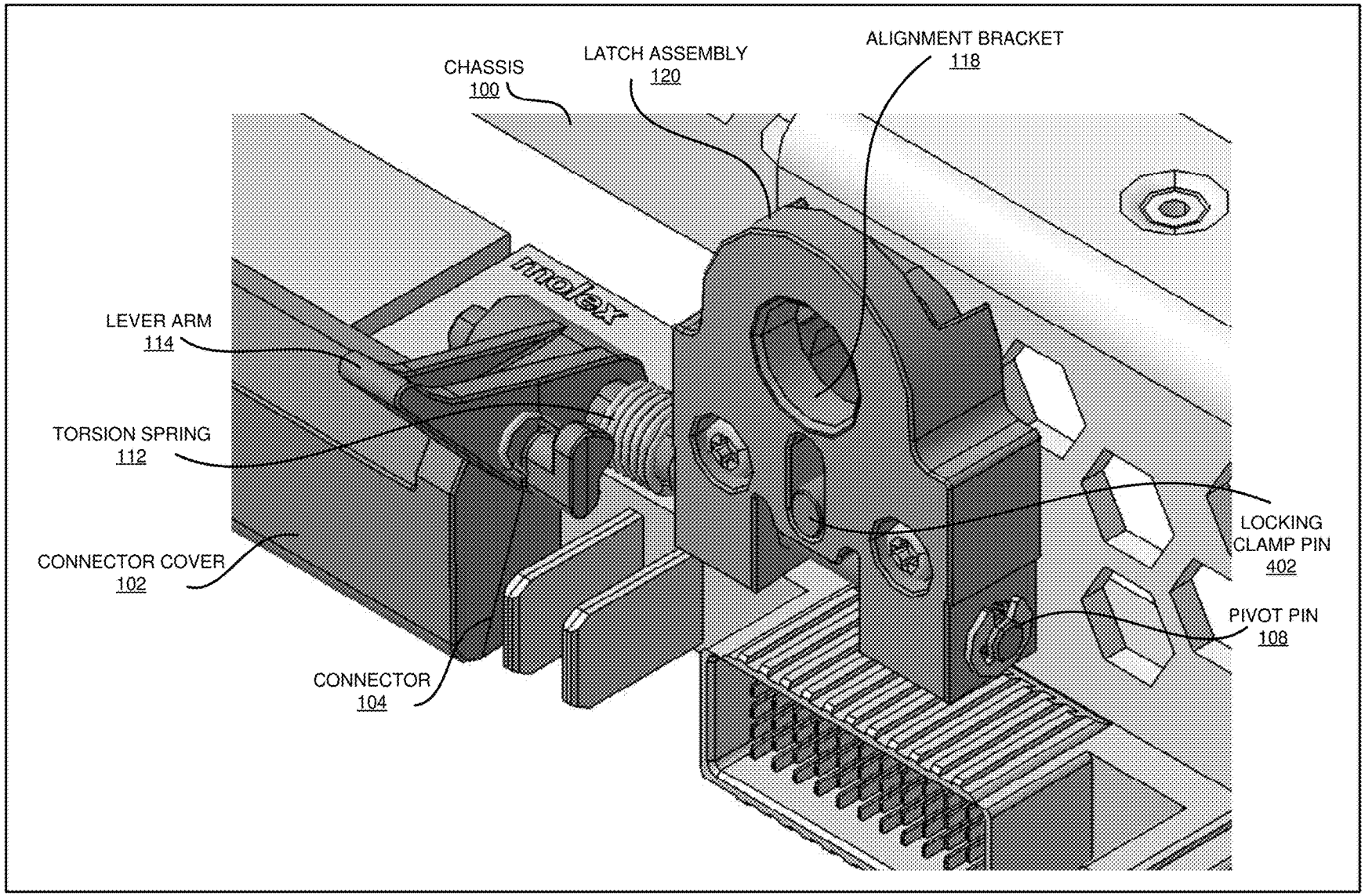
FIG. 4 depicts more detail of an isometric view of an example configuration for a chassis including a connector cover with separate activation and latching mechanisms in accordance with an illustrative embodiment.

With reference to FIG. 4, this figure depicts more detail of an isometric view of an example configuration for a chassis including a connector cover with separate activation and latching mechanisms in accordance with an illustrative embodiment. Chassis 100, connector cover 102, connector 104, pivot pin 108, torsion spring 112, lever arm 114, alignment bracket 118, and latch assembly 120 are the same as connector cover 102, connector 104, pivot pin 108, torsion spring 112, lever arm 114, alignment bracket 118, and latch assembly 120 in FIG. 1.

In particular, FIG. 4 depicts latch assembly 120 in the latched position. Pivot pin 108 extends through torsion spring 112. Torsion spring 112 supplies a torque on connector cover 102 about pivot pin 108, maintaining connector cover 102 in the closed position in the absence of contact with activating pin 302. Locking clamp pin 402 is depicted in the latched position, at one end of a slot, and is constrained to move in only one dimension by the slot.

Figure 5:
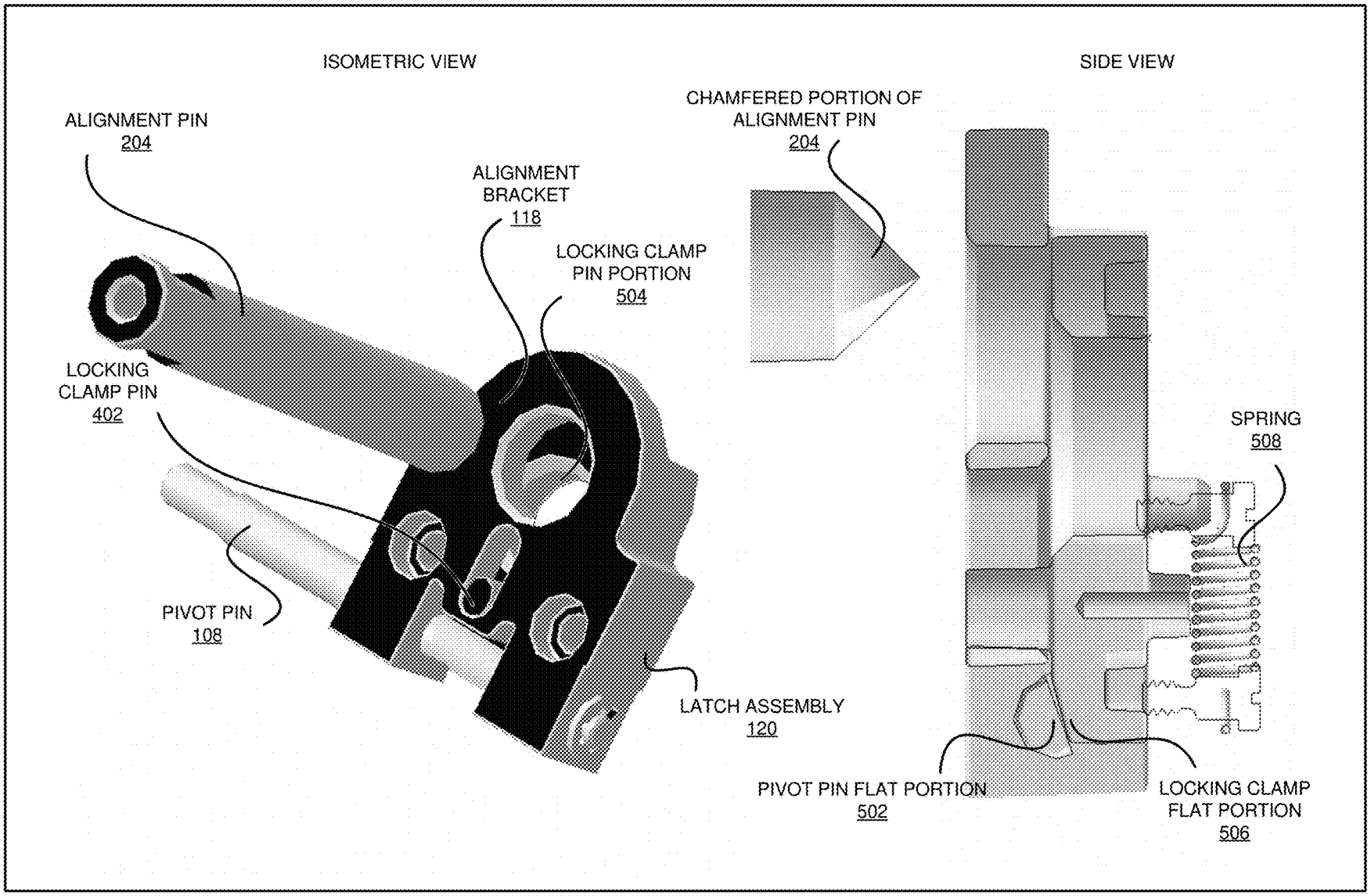
FIG. 5 depicts an isometric view and a side view of an example configuration for a chassis including a connector cover with separate activation and latching mechanisms in accordance with an illustrative embodiment.

With reference to FIG. 5, this figure depicts an isometric view and a side view of an example configuration for a chassis including a connector cover with separate activation and latching mechanisms in accordance with an illustrative embodiment. Pivot pin 108, alignment bracket 118, and latch assembly 120 are the same as pivot pin 108, alignment bracket 118, and latch assembly 120 in FIG. 1. Alignment pin 204 is the same as alignment pin 204 in FIG. 2. Locking clamp pin 402 is the same as locking clamp pin 402 in FIG. 4.

In particular, FIG. 5 depicts an isometric view and a side of latch assembly 120 in the latched position. Locking clamp pin 402 is depicted in the latched position, at one end of a slot, and is constrained to move in only one dimension by the slot. Locking clamp pin portion 504 is part of locking clamp pin 402.

Pivot pin 108 includes a pivot pin flat portion 502. In the latched position, pivot pin flat portion 502 is held engaged against locking clamp flat portion 506 by spring 508. Thus, a locking clamp, including pin 402 and flat portion 506, is clamped, preventing pivot pin 108 from rotating and connector cover 102 from opening.

As depicted, locking clamp pin portion 504 is offset from the opening in alignment bracket 118. When alignment pin 204 is at least partially inserted into alignment bracket 118, a chamfered portion of alignment pin 204 causing locking clamp pin portion 504 to align more closely with the opening in alignment bracket 118, extending spring 508. Extending spring 508 translates locking clamp pin 402 towards the other end of its slot and translates locking clamp flat portion 506 away from pivot pin flat portion 502, disengaging pivot pin flat portion 502 from locking clamp flat portion 506. When pivot pin flat portion 502 is disengaged from locking clamp flat portion 506, a locking clamp, including pin 402 and flat portion 506, is unclamped, pivot pin 108 can rotate, and connector cover 102 can open. Hence, latch assembly 120 has been moved from the latched to the unlatched position.

When latch assembly 120 is in the unlatched position and alignment pin 204 is then removed from insertion into alignment bracket 118, locking clamp pin portion 504 returns to its original offset alignment with alignment bracket 118, allowing spring 508 to return to an nonextended state, translating locking clamp pin 402 back to its original position in its slot and translating locking clamp flat portion 506 towards pivot pin flat portion 502 and reengaging pivot pin flat portion 502 with locking clamp flat portion 506. When pivot pin flat portion 502 is reengaged from locking clamp flat portion 506, the locking clamp, including pin 402 and flat portion 506, is clamped, pivot pin 108 can no longer rotate, and connector cover 102 can no longer open. Hence, latch assembly 120 has been returned to the latched position.

Figure 6:
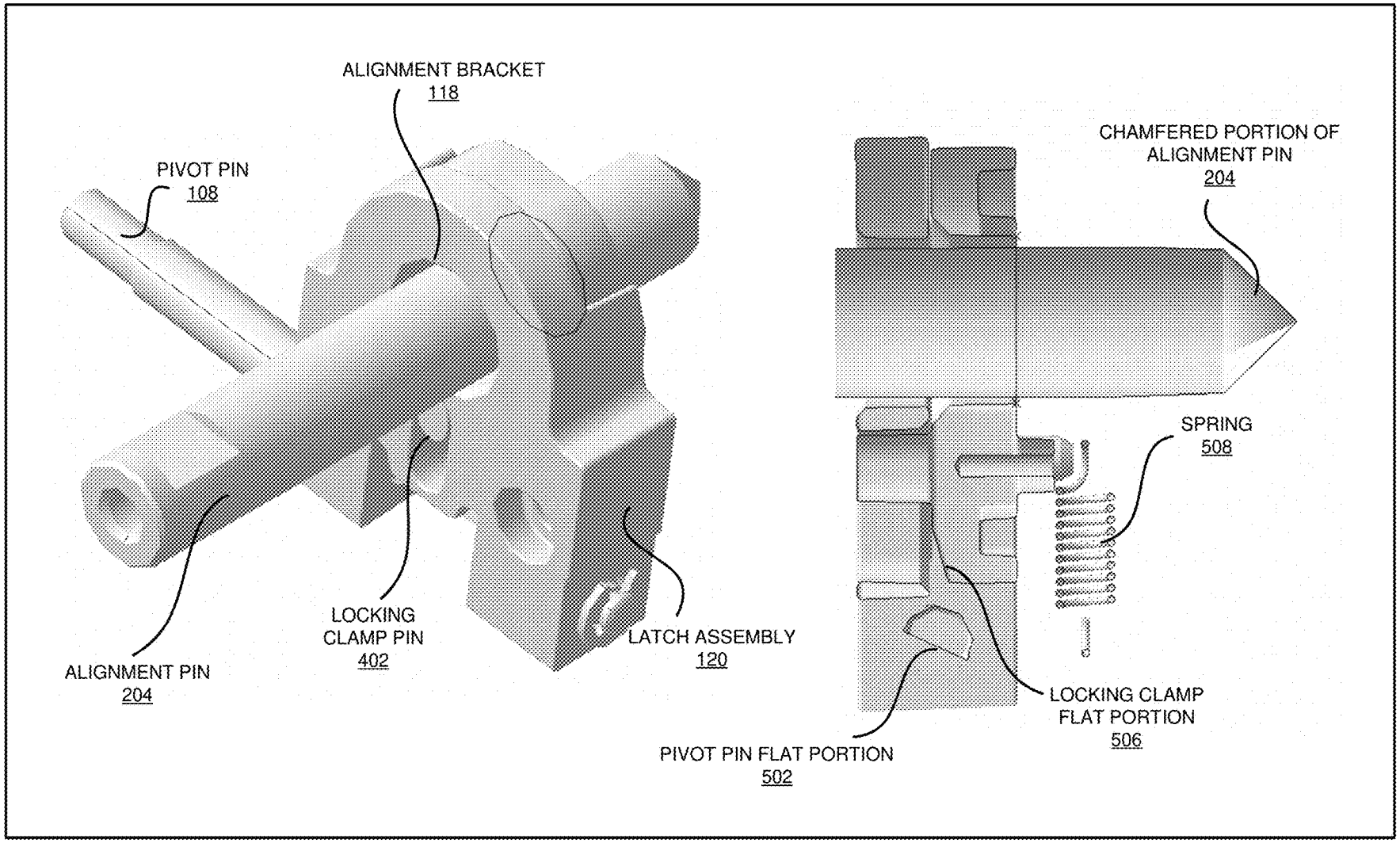
FIG. 6 depicts an isometric view and a side view of an example configuration for a chassis including a connector cover with separate activation and latching mechanisms in accordance with an illustrative embodiment.

With reference to FIG. 6, this figure depicts an isometric view and a side view of an example configuration for a chassis including a connector cover with separate activation and latching mechanisms in accordance with an illustrative embodiment. Pivot pin 108, alignment bracket 118, latch assembly 120, alignment pin 204, locking clamp pin 402, pivot pin flat portion 502, locking clamp flat portion 506, and spring 508 are the same as pivot pin 108, alignment bracket 118, latch assembly 120, alignment pin 204, locking clamp pin 402, pivot pin flat portion 502, locking clamp flat portion 506, and spring 508 in FIG. 5.

In particular, FIG. 6 depicts an isometric view and a side of latch assembly 120 in the unlatched position. Alignment pin 204 has been inserted into alignment bracket 118, causing locking clamp pin portion 504 (not shown) to move vertically in the opening in alignment bracket 118, extending spring 508. As a result, locking clamp pin 402 is at the other end of its slot and locking clamp flat portion 506 has been translated away from pivot pin flat portion 502, disengaging pivot pin flat portion 502 from locking clamp flat portion 506. Because pivot pin flat portion 502 is disengaged from locking clamp flat portion 506, pivot pin 108 can rotate and connector cover 102 can open. Although FIG. 6 and additional figures depict alignment pin 204 as extending through alignment bracket 118, this is not a requirement. In other embodiments, alignment bracket 118 includes an indentation sized to accommodate a portion of alignment pin 204, and alignment pin 204 does not extend all the way through alignment bracket 118.

Figure 7:
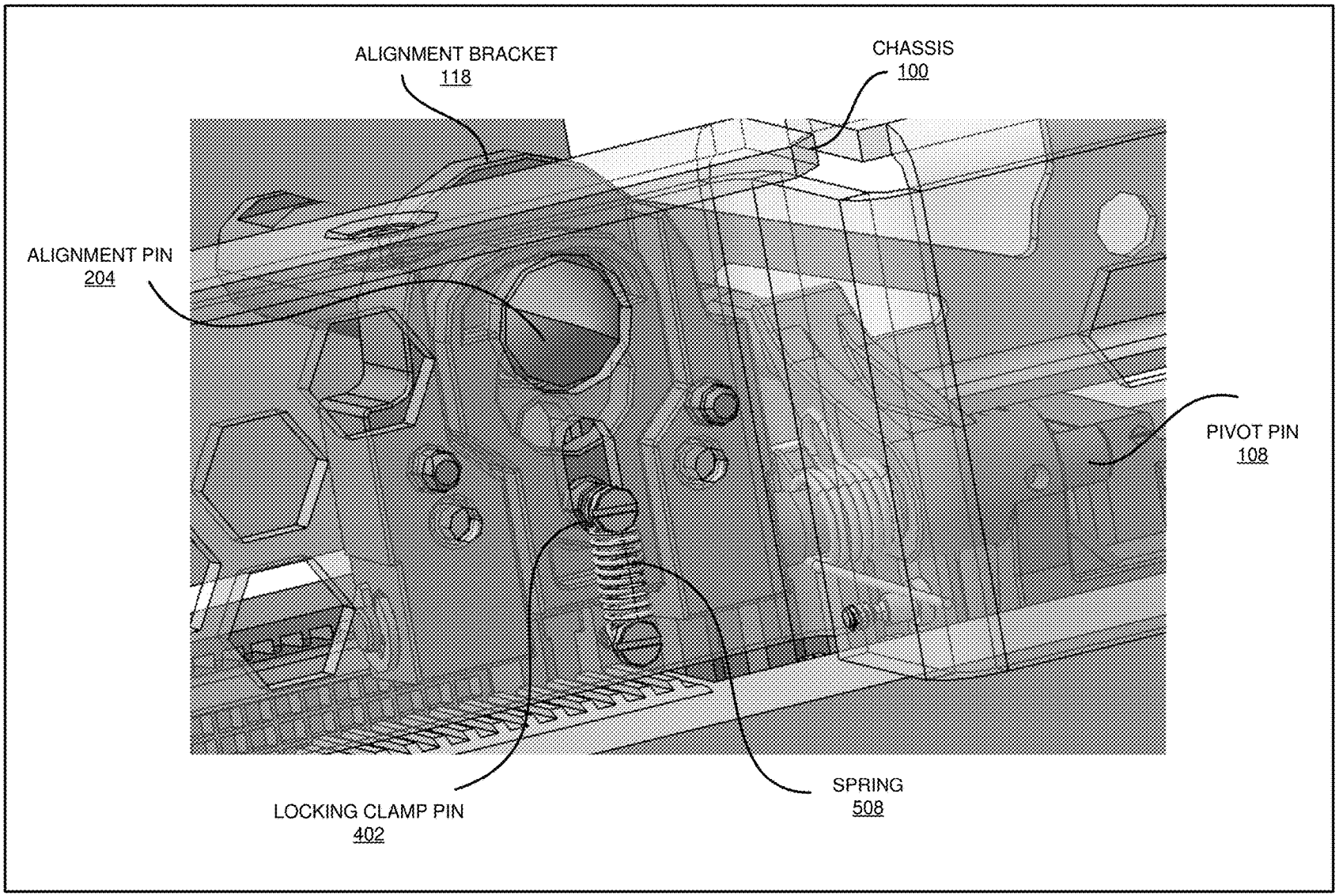
FIG. 7 depicts an additional isometric view of an example configuration for a chassis including a connector cover with separate activation and latching mechanisms in accordance with an illustrative embodiment.

With reference to FIG. 7, this figure depicts an additional isometric view of an example configuration for a chassis including a connector cover with separate activation and latching mechanisms in accordance with an illustrative embodiment. Chassis 100, connector 104, and pivot pin 108 are the same as chassis 100, connector 104, and pivot pin 108 in FIG. 1. Alignment bracket 118, alignment pin 204, locking clamp pin 402, and spring 508 are the same as alignment bracket 118, alignment pin 204, locking clamp pin 402, and spring 508 in FIG. 5.

In particular, FIG. 7 depicts an opposite side of chassis 100 from the side into which alignment pin 204 is at least partially inserted. As depicted, alignment pin 204 has been inserted into alignment bracket 118, extending spring 508. As a result, latch assembly 120 is the unlatched position, in which pivot pin 108 can rotate and connector cover 102 can open.

Figure 8:
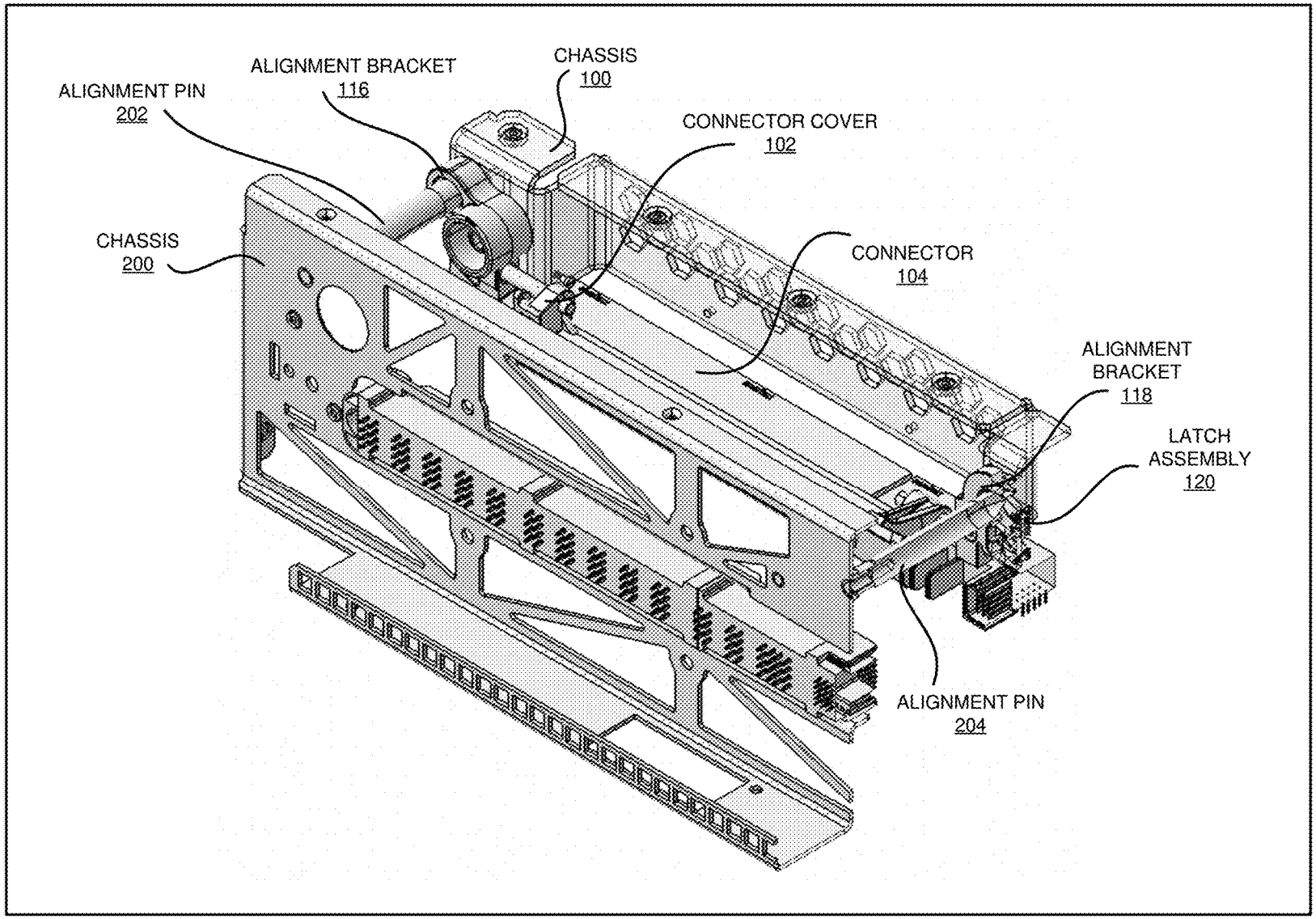
FIG. 8 depicts an isometric view of an example configuration for a chassis including a connector cover with separate activation and latching mechanisms, and a second chassis intended to connect with the chassis, in accordance with an illustrative embodiment.

With reference to FIG. 8, this figure depicts an isometric view of an example configuration for a chassis including a connector cover with separate activation and latching mechanisms, and a second chassis intended to connect with the chassis, in accordance with an illustrative embodiment. Chassis 100, connector cover 102, connector 104, alignment brackets 116 and 118, latch assembly 120, chassis 200, and alignment pins 202 and 204 are the same as chassis 100, connector cover 102, connector 104, alignment brackets 116 and 118, latch assembly 120, chassis 200, and alignment pins 202 and 204 in FIG. 2.

As depicted, alignment pin is at least partially inserted into alignment bracket 116, and alignment pin 204 is at least partially inserted into alignment bracket 118. In addition, alignment pin 204, when at least partially inserted into alignment bracket 118, has caused latch assembly 120 to unlatch.

Figure 9:
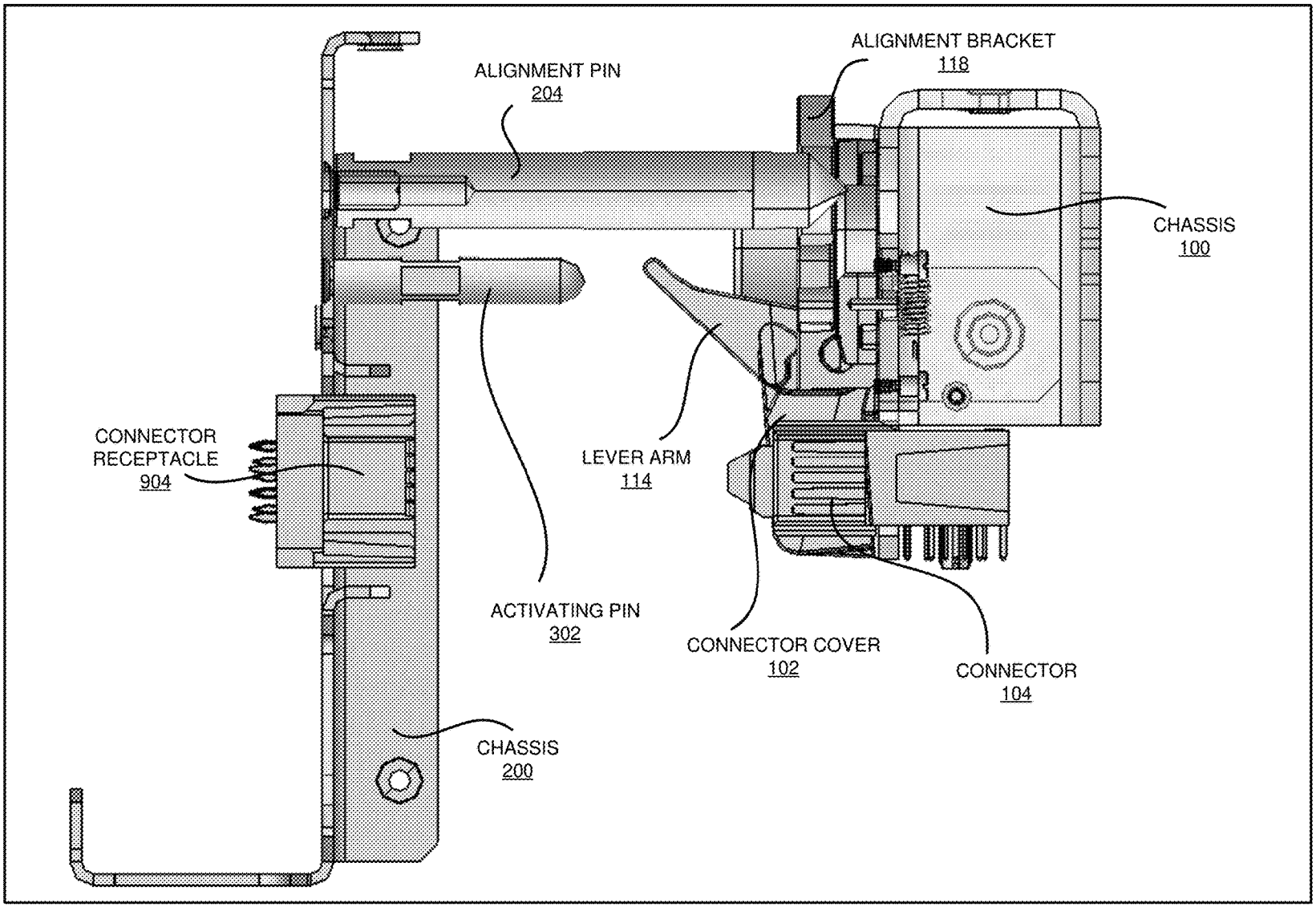
FIG. 9 depicts a section view in a sequence of views of an example configuration for a chassis including a connector cover with separate activation and latching mechanisms, and a second chassis in the process of connecting with the chassis, in accordance with an illustrative embodiment.

With reference to FIG. 9, this figure depicts a section view in a sequence of views of an example configuration for a chassis including a connector cover with separate activation and latching mechanisms, and a second chassis in the process of connecting with the chassis, in accordance with an illustrative embodiment. Chassis 100, connector cover 102, connector 104, lever arm 114, alignment bracket 118, chassis 200, alignment pin 204, and activating pin 302 are the same as chassis 100, connector cover 102, connector 104, lever arm 114, alignment bracket 118, chassis 200, alignment pin 204, and activating pin 302 in FIG. 3.

In particular, the section view illustrates the top of chassis 100 and 200. Alignment pin 204 is depicted at least partially inserted into alignment bracket 118. As a result, latch assembly 120 is in the unlatched position (not shown). Lever arm 114 is coupled to connector cover 102. Lever arm 114 is configured such that, when chassis 100 and 200 are moved closer together, lever arm 114 will contact activating pin 302. Contact with activating pin 302 will overcome a force maintaining connector cover 102 in the closed position and cause connector cover 102 to move from the closed position to the open position. As a result, connector 104 will be able to be coupled to connector receptacle 904 in chassis 200.

Figure 10:
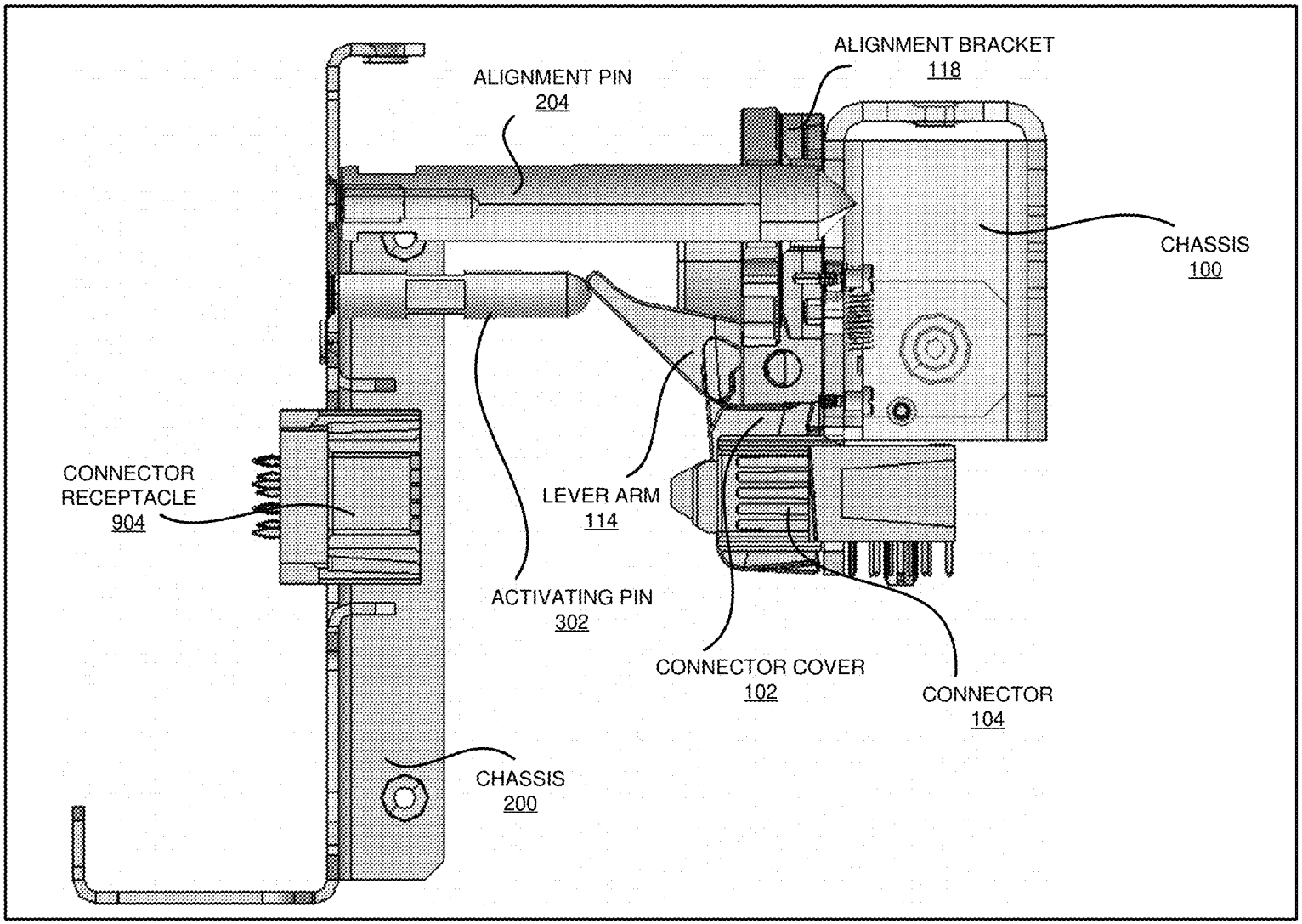
FIG. 10 depicts a section view in a sequence of views of an example configuration for a chassis including a connector cover with separate activation and latching mechanisms, and a second chassis in the process of connecting with the chassis, in accordance with an illustrative embodiment.

With reference to FIG. 10, this figure depicts a section view in a sequence of views of an example configuration for a chassis including a connector cover with separate activation and latching mechanisms, and a second chassis in the process of connecting with the chassis, in accordance with an illustrative embodiment. Chassis 100, connector cover 102, connector 104, lever arm 114, alignment bracket 118, chassis 200, alignment pin 204, activating pin 302, and connector receptacle 904 are the same as chassis 100, connector cover 102, connector 104, lever arm 114, alignment bracket 118, chassis 200, alignment pin 204, activating pin 302, and connector receptacle 904 in FIG. 9.

In particular, the section view illustrates the top of chassis 100 and 200. Alignment pin 204 is depicted at least partially inserted into alignment bracket 118. As a result, latch assembly 120 is in the unlatched position (not shown). Chassis 100 and 200 have moved closer together with respect to FIG. 9, and as a result lever arm 114 is in contact with activating pin 302. However, connector cover 102 is still in the closed position covering connector 104.

Figure 11:
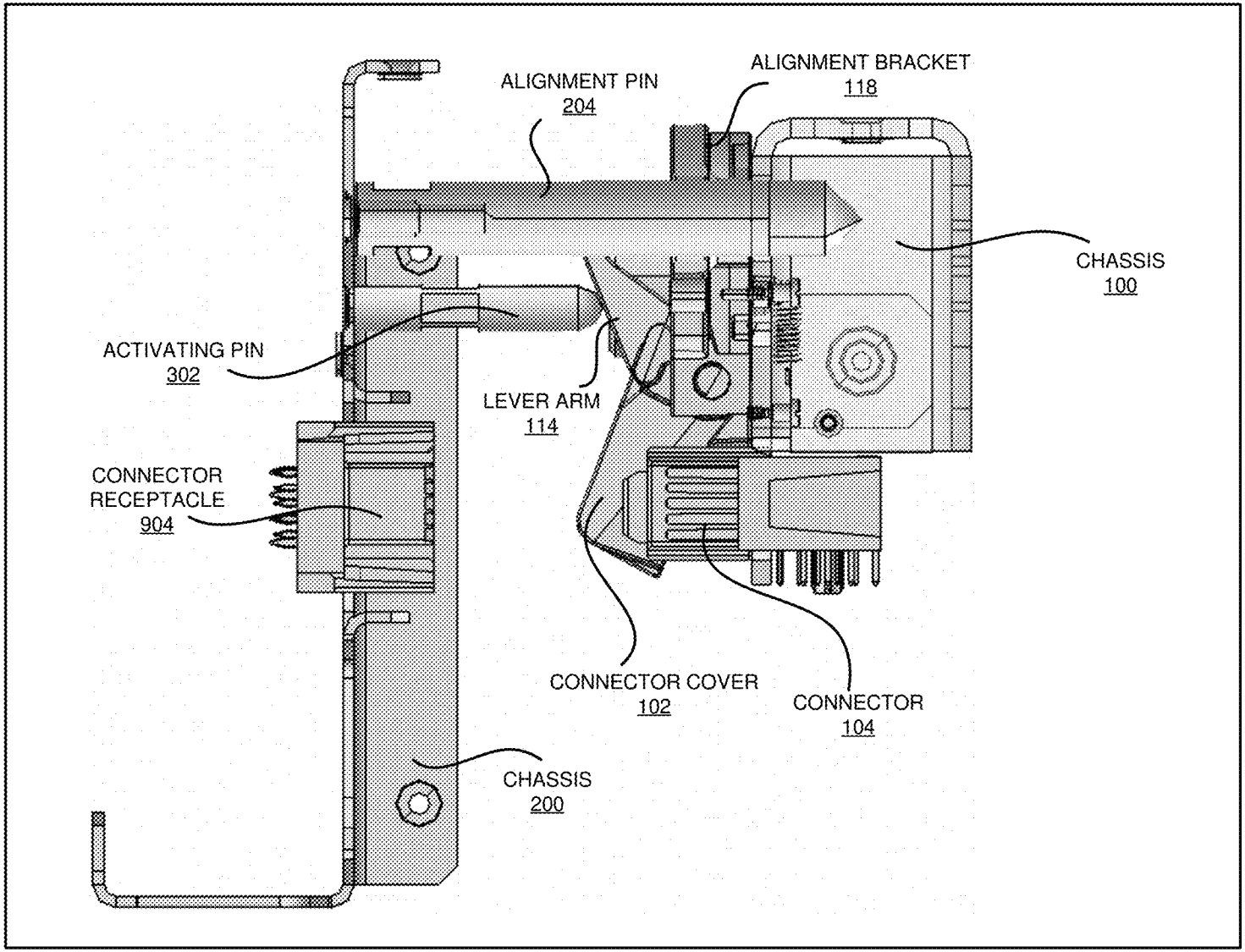
FIG. 11 depicts a section view in a sequence of views of an example configuration for a chassis including a connector cover with separate activation and latching mechanisms, and a second chassis in the process of connecting with the chassis, in accordance with an illustrative embodiment.

With reference to FIG. 11, this figure depicts a section view in a sequence of views of an example configuration for a chassis including a connector cover with separate activation and latching mechanisms, and a second chassis in the process of connecting with the chassis, in accordance with an illustrative embodiment. Chassis 100, connector cover 102, connector 104, lever arm 114, alignment bracket 118, chassis 200, alignment pin 204, activating pin 302, and connector receptacle 904 are the same as chassis 100, connector cover 102, connector 104, lever arm 114, alignment bracket 118, chassis 200, alignment pin 204, activating pin 302, and connector receptacle 904 in FIG. 9.

In particular, the section view illustrates the top of chassis 100 and 200. Alignment pin 204 is depicted at least partially inserted into alignment bracket 118. As a result, latch assembly 120 is in the unlatched position (not shown). Chassis 100 and 200 have moved closer together with respect to FIG. 10, and as a result activating pin 302 has moved lever arm 114, overcoming a force maintaining connector cover 102 in the closed position and causing connector cover 102 to move from the closed position to a partially open position. When chassis 100 and 200 are moved even closer together, connector cover 102 will move from the depicted partially open position to a completely open position, and connector 104 will be able to be coupled to connector receptacle 904 in chassis 200.

Figure 12:
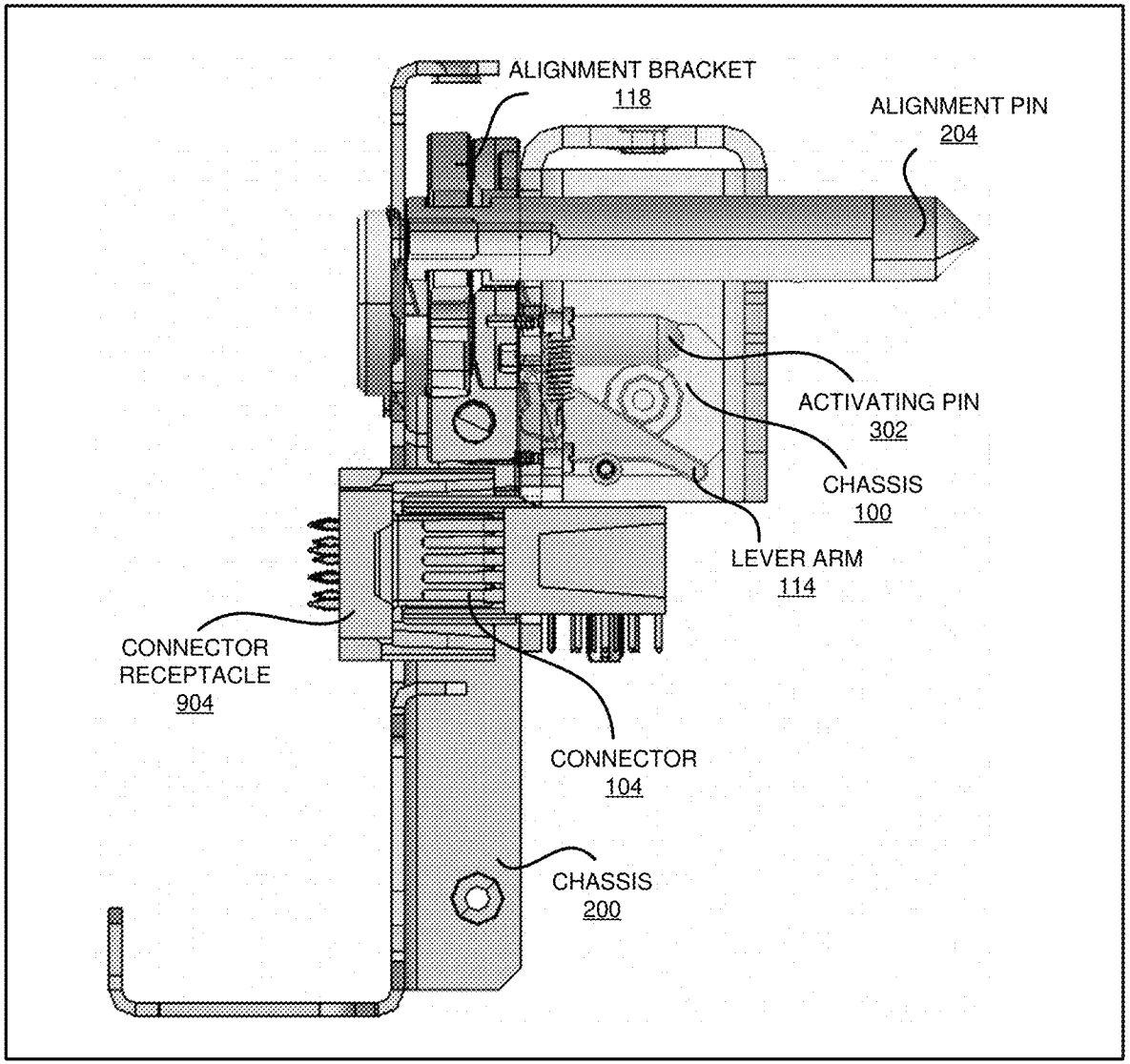
FIG. 12 depicts a section view in a sequence of views of an example configuration for a chassis including a connector cover with separate activation and latching mechanisms, and a second chassis in the process of connecting with the chassis, in accordance with an illustrative embodiment.

With reference to FIG. 12, this figure depicts a section view in a sequence of views of an example configuration for a chassis including a connector cover with separate activation and latching mechanisms, and a second chassis in the process of connecting with the chassis, in accordance with an illustrative embodiment. Chassis 100, connector cover 102, connector 104, lever arm 114, alignment bracket 118, chassis 200, alignment pin 204, activating pin 302, and connector receptacle 904 are the same as chassis 100, connector cover 102, connector 104, lever arm 114, alignment bracket 118, chassis 200, alignment pin 204, activating pin 302, and connector receptacle 904 in FIG. 9.

In particular, the section view illustrates the top of chassis 100 and 200. Alignment pin 204 is depicted at least partially inserted into alignment bracket 118. As a result, latch assembly 120 is in the unlatched position (not shown). Chassis 100 and 200 have moved closer together with respect to FIG. 11, and as a result activating pin 302 has moved lever arm 114, overcoming a force maintaining connector cover 102 in the closed position and causing connector cover 102 to move to a fully open position. Thus, connector 104 is coupled to connector receptacle 904 in chassis 200.

Figure 13:
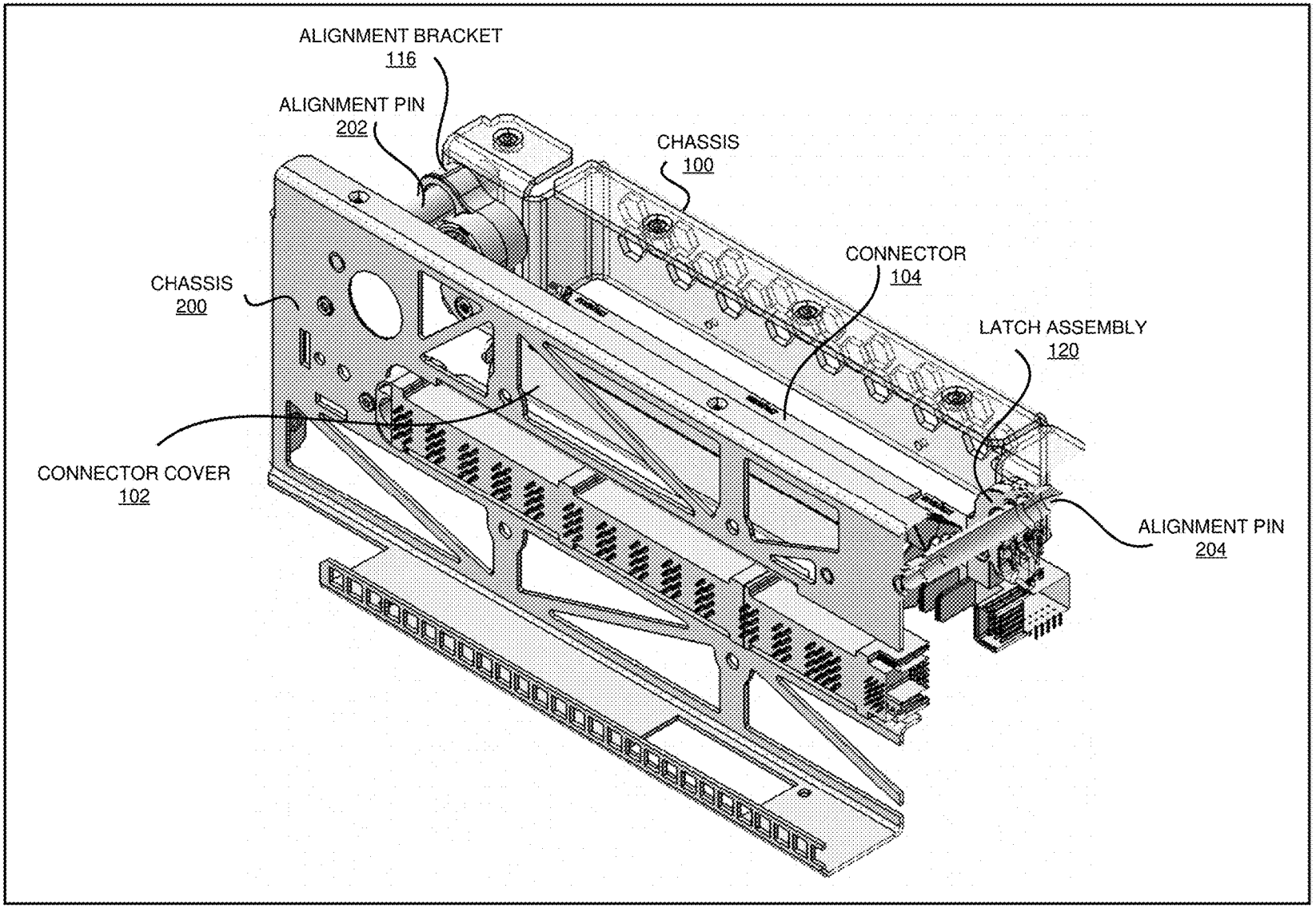
FIG. 13 depicts an isometric view in a sequence of views of an example configuration for a chassis including a connector cover with separate activation and latching mechanisms, and a second chassis in the process of connecting with the chassis, in accordance with an illustrative embodiment.

With reference to FIG. 13, this figure depicts an isometric view in a sequence of views of an example configuration for a chassis including a connector cover with separate activation and latching mechanisms, and a second chassis in the process of connecting with the chassis, in accordance with an illustrative embodiment. Chassis 100, connector cover 102, connector 104, alignment bracket 116, latch assembly 120, chassis 200, and alignment pins 202 and 204 are the same as chassis 100, connector cover 102, connector 104, alignment bracket 116, latch assembly 120, chassis 200, and alignment pins 202 and 204 in FIG. 2.

Alignment pin 204 has been at least partially inserted into alignment bracket 118 (not shown). As a result, latch assembly 120 is in the unlatched position (not shown). Chassis 100 and 200 have moved closer together with respect to FIG. 2, and as a result activating pin 302 (not shown) has caused connector cover 102 to move from the closed position to a partially open position.

Figure 14:
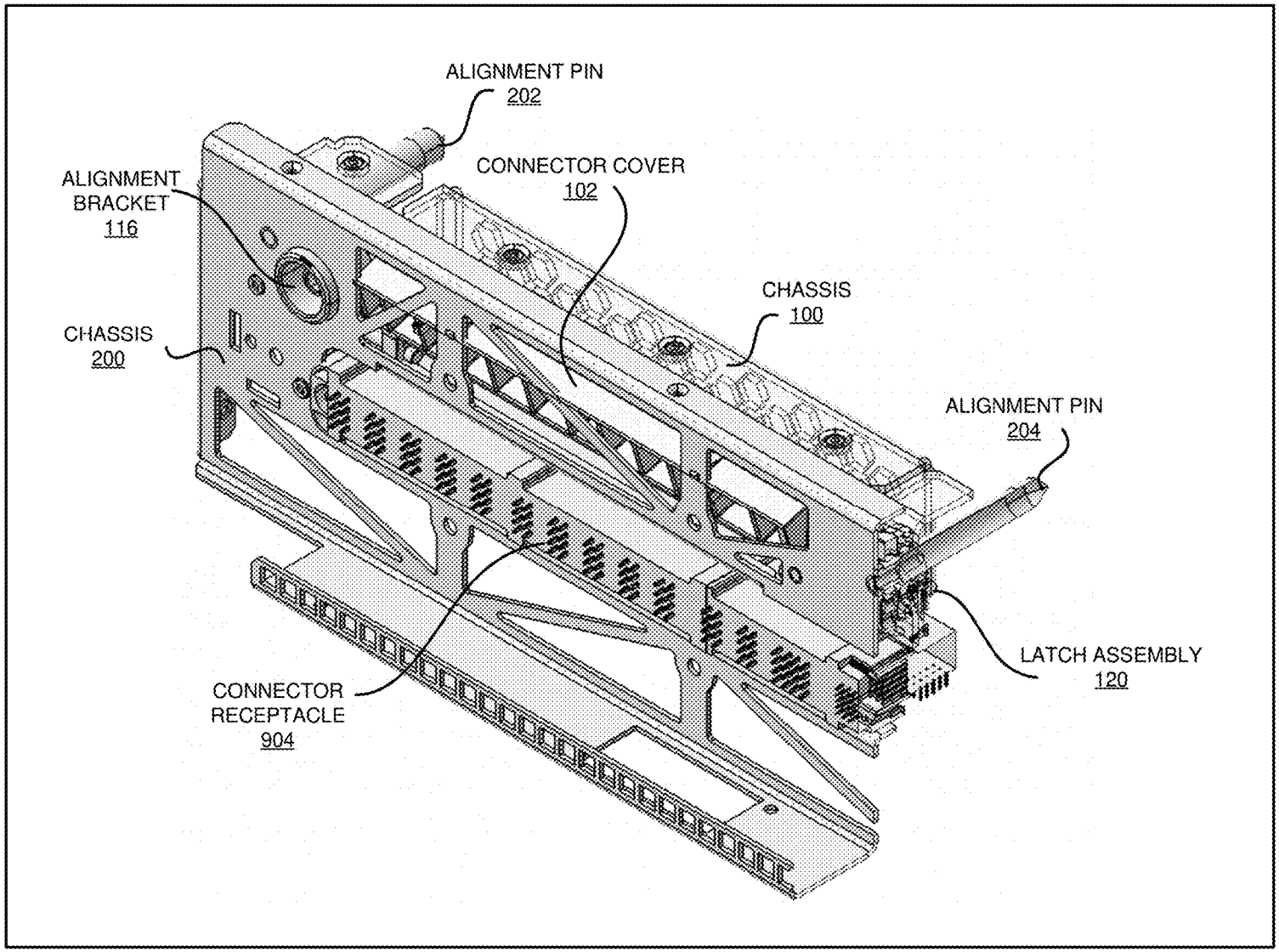
FIG. 14 depicts an isometric view in a sequence of views of an example configuration for a chassis including a connector cover with separate activation and latching mechanisms, and a second chassis in the process of connecting with the chassis, in accordance with an illustrative embodiment.

With reference to FIG. 14, this figure depicts an isometric view in a sequence of views of an example configuration for a chassis including a connector cover with separate activation and latching mechanisms, and a second chassis in the process of connecting with the chassis, in accordance with an illustrative embodiment. Chassis 100, connector cover 102, alignment bracket 116, latch assembly 120, chassis 200, and alignment pins 202 and 204 are the same as chassis 100, connector cover 102, alignment bracket 116, latch assembly 120, chassis 200, and alignment pins 202 and 204 in FIG. 2. Connector receptacle 904 is the same as connector receptacle 904 in FIG. 9.

Alignment pin 204 has been at least partially inserted into alignment bracket 118 (not shown). As a result, latch assembly 120 is in the unlatched position (not shown). Chassis 100 and 200 have moved closer together with respect to FIG. 13, and as a result activating pin 302 (not shown) has caused connector cover 102 to move from the closed position to a completely open position. Thus, connector 104 (not shown) is able to be coupled to its counterpart, connector receptacle 904 in chassis 200.

Figure 15:
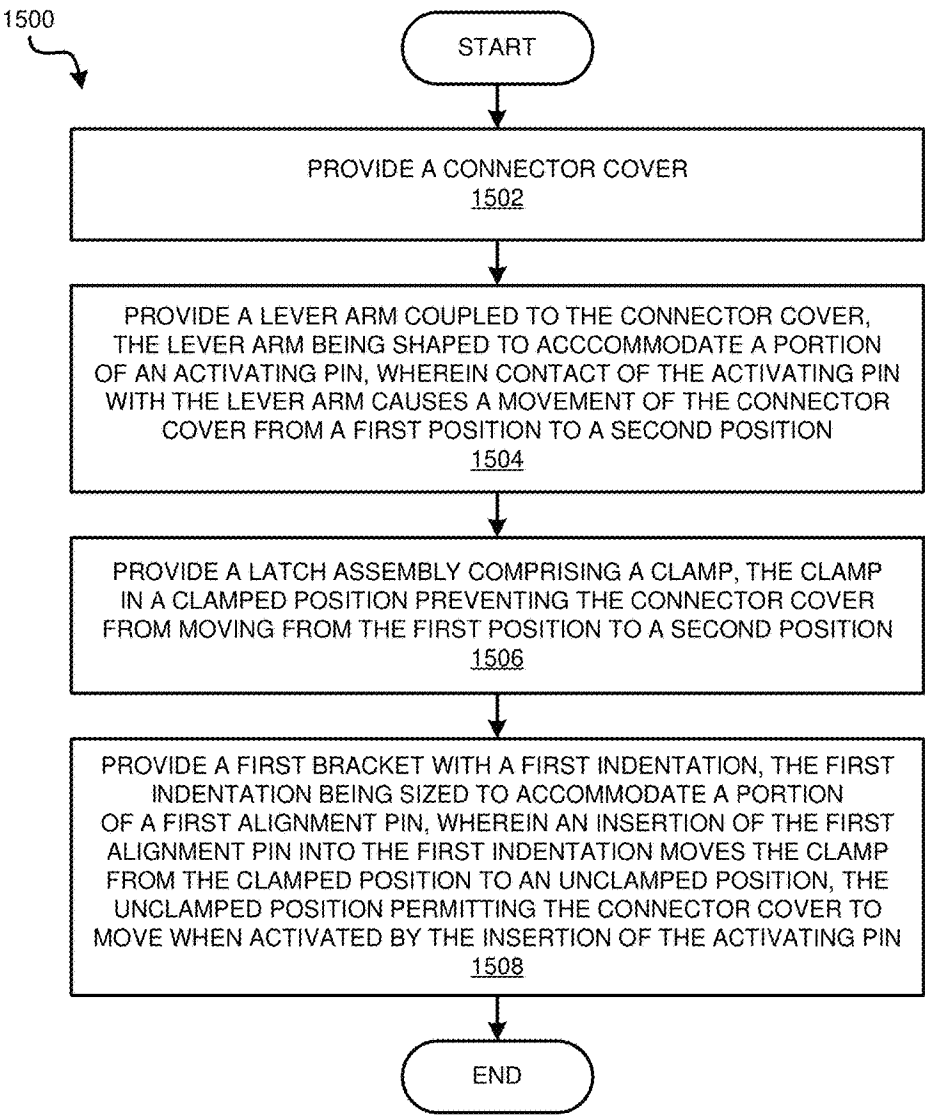
FIG. 15 depicts a flowchart of an example process for providing a connector cover with separate activation and latching mechanisms in accordance with an illustrative embodiment.

With reference to FIG. 15, this figure depicts a flowchart of an example process for providing a connector cover with separate activation and latching mechanisms in accordance with an illustrative embodiment.

In block 1502 of method 1500, an embodiment provides a connector cover. In block 1504, an embodiment provides a lever arm coupled to the connector cover, the lever arm being shaped to accommodate a portion of an activating pin, wherein contact of the activating pin with the lever arm causes a movement of the connector cover from a first position to a second position. In block 1506, an embodiment provides a latch assembly comprising a clamp, the clamp in a clamped position preventing the connector cover from moving from the first position to a second position. In block 1508, an embodiment provides a first bracket with a first indentation, the first indentation being sized to accommodate a portion of a first alignment pin, wherein an insertion of the first alignment pin into the first indentation moves the clamp from the clamped position to an unclamped position, the unclamped position permitting the connector cover to move when activated by the insertion of the activating pin. Then method 1500 ends.

Thus, an apparatus and method are provided in the illustrative embodiments for a connector cover with separate activation and latching mechanisms and other related features, functions, or operations. Where an embodiment or a portion thereof is described with respect to a type of device, the apparatus and method, or a portion thereof, are adapted or configured for use with a suitable and comparable manifestation of that type of device.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

What is claimed is:

1. An apparatus comprising:

a connector cover;

a lever arm coupled to the connector cover, the lever arm being shaped to accommodate a portion of an activating pin of a complementary apparatus, wherein contact of the activating pin with the lever arm causes a movement of the connector cover from a first position to a second position;

a latch assembly comprising a clamp, the clamp in a clamped position preventing the connector cover from moving from the first position to a second position; and an alignment bracket with an indentation, the indentation being sized to accommodate a portion of an alignment pin of the complementary apparatus, wherein an insertion of the alignment pin into the indentation moves the clamp from the clamped position to an unclamped position, the unclamped position permitting the connector cover to move when activated by the insertion of the activating pin.

2. The apparatus of claim 1, wherein the first position of the connector comprises a closed position and the second position of the connector comprises an open position.

3. The apparatus of claim 1, wherein the connector cover is coupled to a pivot pin and contact of the activating pin with the lever arm causes a rotation of the connector cover and the pivot pin.

4. The apparatus of claim 1, wherein absence of contact of the activating pin with the lever arm causes a movement of the connector cover from the second position to the first position.

5. The apparatus of claim 1, wherein the connector cover is coupled to a pivot pin and absence of contact of the activating pin with the lever arm causes a rotation of the connector cover and the pivot pin from the second position to the first position.

6. The apparatus of claim 1, wherein the clamp in the clamped position prevents the connector cover from moving from the first position to the second position.

7. The apparatus of claim 1, wherein absence of insertion of the alignment pin into the indentation moves the clamp from the unclamped position to the clamped position, the clamped position preventing the connector cover from moving when activated by the insertion of the activating pin.

8. The apparatus of claim 1, further comprising a holding mechanism mounted on a pivot pin, the holding mechanism maintaining the connector cover in the first position in the absence of the activating pin.

9. The apparatus of claim 8, wherein the holding mechanism comprises a torsion spring.

10. The apparatus of claim 1, wherein the latch assembly further comprises an extension mechanism, the insertion of the alignment pin extending the extension mechanism, the extension of the extension mechanism moving the clamp from the clamped position to the unclamped position.

11. The apparatus of claim 10, wherein the extension mechanism comprises a compression spring, the insertion of the alignment pin extending the compression spring.

12. The apparatus of claim 1, wherein the connector cover covers a chassis portion, the connector cover preventing access to the chassis portion when the connector cover is in the first position, the connector cover allowing access to the chassis portion when the connector cover is in the second position.

13. The apparatus of claim 12, wherein the chassis portion comprises a first electrical connector, the connector cover allowing a second electrical connector to electrically couple to the first electrical connector when the connector cover is in the second position.

14. The apparatus of claim 1, wherein the alignment pin is longer than the activating pin.

15. The apparatus of claim 1, wherein the first indentation comprises a first opening.

16. An apparatus comprising:

a first chassis, the first chassis comprising:

a connector cover;

a lever arm coupled to the connector cover, the lever arm being shaped to accommodate a portion of an activating pin, wherein contact of the activating pin with the lever arm causes a movement of the connector cover from a first position to a second position;

a latch assembly comprising a clamp, the clamp in a clamped position preventing the connector cover from moving from the first position to a second position; and a first alignment bracket with a first indentation, the first indentation being sized to accommodate a portion of a first alignment pin, wherein an insertion of the first alignment pin into the first indentation moves the clamp from the clamped position to an unclamped position, the unclamped position permitting the connector cover to move when activated by the insertion of the activating pin; and a second chassis, the second chassis comprising:

the activating pin; and the first alignment pin.

17. The apparatus of claim 16, further comprising:

the first chassis further comprising a second alignment bracket with a second indentation, the second indentation being sized to accommodate a portion of a second alignment pin;

the second chassis further comprising the second alignment pin; and the first alignment pin and the second alignment pin aligning a first connector of the first chassis with a second connector of the second chassis, the aligning allowing the first connector to couple to the second connector when the connector cover is in the second position.

18. The apparatus of claim 16, wherein the connector cover covers a portion of the first chassis, the connector cover preventing access to the portion when the connector cover is in the first position, the connector cover allowing access to the portion when the connector cover is in the second position.

19. The apparatus of claim 16, wherein the latch assembly further comprises an extension mechanism, the insertion of the first alignment pin extending the extension mechanism, the extension of the extension mechanism moving the clamp from the clamped position to the unclamped position.

20. A method comprising:

providing a connector cover;

providing a lever arm coupled to the connector cover, the lever arm being shaped to accommodate a portion of an activating pin, wherein contact of the activating pin with the lever arm causes a movement of the connector cover from a first position to a second position;

providing a latch assembly comprising a clamp, the clamp in a clamped position preventing the connector cover from moving from the first position to a second position; and providing a first alignment bracket with a first indentation, the first indentation being sized to accommodate a portion of a first alignment pin, wherein an insertion of the first alignment pin into the first indentation moves the clamp from the clamped position to an unclamped position, the unclamped position permitting the connector cover to move when activated by the insertion of the activating pin.

* * * * *